US008875676B2

(12) United States Patent
Geyer et al.

(10) Patent No.: US 8,875,676 B2
(45) Date of Patent: Nov. 4, 2014

(54) ROLLER TAPPET

(75) Inventors: Norbert Geyer, Hochstadt (DE); Stefan Dorn, Hollfeld (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/700,476

(22) PCT Filed: Apr. 20, 2011

(86) PCT No.: PCT/EP2011/056296
§ 371 (c)(1),
(2), (4) Date: Nov. 28, 2012

(87) PCT Pub. No.: WO2011/151108
PCT Pub. Date: Dec. 8, 2011

(65) Prior Publication Data

US 2013/0068064 A1 Mar. 21, 2013

(30) Foreign Application Priority Data

Jun. 1, 2010 (DE) ..... 10 2010 022 318

(51) Int. Cl.
*F01L 1/14* (2006.01)
*F02M 59/10* (2006.01)
*F04B 1/04* (2006.01)

(52) U.S. Cl.
CPC ..... *F04B 1/0417* (2013.01); *F01L 1/14* (2013.01); *F01L 2105/02* (2013.01); *F02M 59/102* (2013.01); *F01L 2105/00* (2013.01); *F01L 2101/00* (2013.01); *F01L 2107/00* (2013.01); *F01L 2103/00* (2013.01); *F01L 1/143* (2013.01)
USPC ..... 123/90.48

(58) Field of Classification Search
CPC ..... F01L 1/14; F01L 2101/00; F01L 2105/02; F01L 2105/00; F01L 1/143; F04B 1/0417; F02M 59/102
USPC ..... 123/90.48–90.59
See application file for complete search history.

(56) References Cited

U.S. PATENT DOCUMENTS 1,998,612 A * 4/1935 Ford ..... 123/90.51
4,231,267 A * 11/1980 Van Slooten ..... 74/569

(Continued)

FOREIGN PATENT DOCUMENTS

DE 19958314 6/2001
DE 102006028348 10/2007

(Continued)

OTHER PUBLICATIONS

English Language Machine Translation of DE 102006057246.*

*Primary Examiner* — Kenneth Bomberg
*Assistant Examiner* — Wesley Harris
(74) *Attorney, Agent, or Firm* — Volpe and Koenig, P.C.

(57) ABSTRACT

A roller tappet (1) is proposed for a high-pressure fuel pump of an internal combustion engine, having a housing (2), in the case of the drive-side end (3) of which two surfaces (5) which lie diametrically opposite one another and are depressed by an outer shell (4) of the housing (2) are applied with in each case one receptacle (6), in which surfaces (5) a pin (8) is mounted which carries a cam roller (7), wherein an inner shell (9) of the housing (2), axially below the cam roller (7) as viewed in the direction remote from the drive, is penetrated by a bridge piece (10), the output-side end (11) of which has a rest (12) for a tappet following part, wherein the outer shell (4) of the housing (2) which is non-stepped as least as far as possible apart from the surfaces (5) is provided as a closed circumferential ring (14), as viewed in the drive direction immediately above upper sides (13) of the surfaces (5), which upper sides (13) run through the housing (2) in the manner of chords, which closed circumferential ring (14) is adjoined by the drive-side end (3), and wherein the receptacles (6) are present in the surfaces (5) as cut-outs which emanate from their upper sides (13) and nestle around the pin (8) in the manner of half-shells.

11 Claims, 1 Drawing Sheet

(56) References Cited

U.S. PATENT DOCUMENTS

| | | | | |
|---|---|---|---|---|
| 5,385,124 | A | 1/1995 | Hillebrand et al. | |
| 6,688,269 | B1 * | 2/2004 | Steinmetz | 123/90.48 |
| 7,096,837 | B2 * | 8/2006 | Kieninger et al. | 123/90.44 |

FOREIGN PATENT DOCUMENTS

| | | |
|---|---|---|
| DE | 102006028851 | 12/2007 |
| DE | 102006054404 | 5/2008 |
| DE | 102006057246 | 6/2008 |

* cited by examiner

ROLLER TAPPET

BACKGROUND

The invention concerns a roller tappet particularly for a high pressure fuel pump or for a valve train of a quality or quantity regulated internal combustion engine, said roller tappet comprising a housing on whose drive side end are arranged two diametrically opposing flats that are pressed in from an outer peripheral surface of the housing, each of said flats comprising a receptacle, a pin carrying a cam roller being mounted in said flats, an inner peripheral surface of the housing, as viewed in a drive distal direction, being penetrated axially below the cam roller by a bridge member, and a driven side end of the bridge member comprising a support for a tappet follower.

A generic roller tappet is disclosed in FIG. 1 of DE 10 2006 028 851 A1. The pin of this roller tappet for the cam roller is fixed by positive and force engagement either through a front-end caulking or through a radial spot or gyratory riveting.

The pre-cited measures necessitate separate machines and lead to an unnecessary increase of manufacturing costs and time. In addition, a quality control of the caulked or riveted connection proves to be relatively complex and destructive. Besides this, it is clear that a person skilled in the art who considers implementing the aforesaid method is restricted in the choice of the material for the pin although the more recent prior art also manifests core hardened and subsequently radial spot riveted pins (s. DE 10 2006 054 404 A1).

Alternatively to the aforesaid measures, U.S. Pat. No. 5,385,124 discloses a snap ring and groove connection for a pin. This necessitates additional work steps for working the groove and mounting the snap ring, the more so because, according to the standard, the surrounding structure of the bore for the pin with groove requires a minimum width and the grooves needed in the surrounding structure as well as in the pin weaken the material of each of these.

Moreover, a centerless grinding of an outer peripheral surface of the housing of the roller tappet according to the pre-cited document DE 10 2006 028 851 A1 proves to be problematic because there is a danger for the housings, which have to be positioned anew for grinding, to tilt out of place.

SUMMARY

It is therefore an object of the invention to provide a roller tappet of the initially cited type in which the above drawbacks are eliminated. In particular, the roller tappet must be inexpensive to manufacture and possess a very simple pin retention arrangement.

According to the invention, the above object is achieved by the fact that the outer peripheral wall of the housing, except for the flats, is configured at least substantially without steps as a closed circumferential ring that, as viewed in drive direction, extends directly above upper sides of the flats, which upper sides extend with a bowstring-like shape through the housing, said circumferential ring being adjoined by the drive side end, and the receptacles in the flats being configured in form of semi-shell-like recesses that start from said upper sides and are in osculating contact with the pin.

The housing of the roller tappet made preferably of inexpensive sheet steel, although a solid configuration of the housing is also imaginable, can thus be finely finished on its outer peripheral wall by a centerless grinding method without tilting. The closed circumferential ring situated near the drive side end has an outer diameter equal to that of the rest of the housing.

The pin is either placed through its ends "loosely" in the semi-shell-like receptacles of the flats or, according to a further specification of the invention, the pin is retained by ends of side surfaces of the receptacles projecting slightly over its upper sides, so that at the least, a good transportation safety device is created. To a person skilled in the art it is clear that a mounting of the pin with cam roller by a simple placing or by snapping in "from the top" is the most economic option.

In an appropriate embodiment of the invention the pin is given an axial guidance through a contact of a respective one of its ends with an inner side of a bow-like segment of the circumferential ring associated to a corresponding one of the flats. In this way, the pin contacts the circumferential ring with only one ring segment of its respective end and is slightly movable in axial direction.

The flats comprising the recesses are connected preferably integrally to the housing and are generated, for example, through a rudimentary stamping of a peripheral region of the housing radially inwards.

A particularly simple-to-implement heat treatment method for the pin forms the subject matter of a further dependent claim. According to this feature, the pin is core hardened.

It is indeed possible to connect the bridge member comprising the support for the tappet follower (pump tappet/gas exchange valve/tappet pushrod) integrally to the inner peripheral wall of the housing. However, the bridge member is made preferably as a separate and thin-walled element like a sheet metal component that bears against undersurfaces of the flats in drive direction while being situated in driven direction behind one or more snap lugs, or the like, projecting from the inner peripheral surface of the housing.

In order to dispense with an additional anti-rotation device to be fixed in the housing (with a possible danger of loss), the invention proposes to provide an extension that projects from an outer peripheral wall of the bridge member and extends, in the installed state, through an aperture of the housing to protrude beyond the outer peripheral wall of the housing.

Last but not least, it is proposed to let the cam roller extend via a low-friction rolling bearing-mounting on the pin, but a slide mounting is also feasible.

BRIEF DESCRIPTION OF THE DRAWINGS

The invention will now be described with reference to the drawing which shows.

DETAILED DESCRIPTION OF THE PREFERRED EMBODIMENTS

Figure 1:
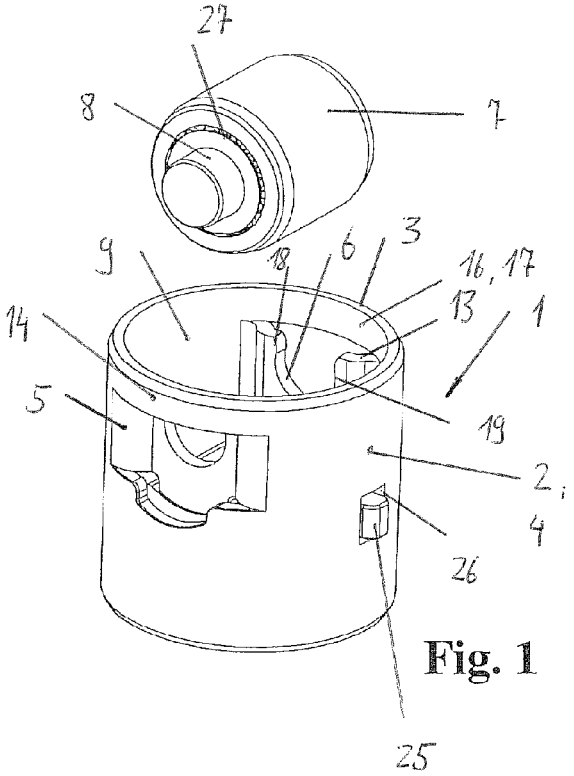
FIG. 1, a perspective view of a roller tappet, with exploded illustration of a cam roller.

The drawing shows a roller tappet 1 for a high pressure fuel pump of an internal combustion engine. The roller tappet 1 comprises a housing 2 near whose drive side end 3 are arranged two diametrically opposing flats 5 which are pressed in from an outer peripheral surface 4 of the housing 2, each of said flats 5 comprising a receptacle 6. A pin 8 is mounted in the receptacles 6. A cam roller 7 extends on this pin 8 via a rolling bearing mounting 27.

A thin-walled bridge member 10 made of sheet steel extends axially below the cam roller 7 through an inner peripheral surface 9 of the housing 2. A finger-like extension 25 is made integrally on the outer peripheral surface 24 of the bridge member 10. This extension 25 constitutes an anti-rotation device by extending through an aperture 26 of the housing 2. A driven side end 11 of the bridge member 10 comprises a support 12 for a tappet follower (here, a pump piston).

It can be seen that the outer peripheral surface 4 of the housing 2 is configured, except for the flats 5, without steps and is therefore illustrated as a closed circumferential ring 14 above upper sides 13 of the flats 5, which upper sides, as viewed in a top view, extend in a bowstring-like shape through the housing 2. The receptacles 6 in the flats 5 are configured in the form of semi-shell-like recesses starting from the upper sides 13 of the flats 5 and osculating with the pin 8. In this way, during a centerless grinding of the outer peripheral surface 4 of the housing 2, the housing 2 can no longer tilt as mentioned above.

For assembly, the pin 8, together with the cam roller 7, is simply placed from the top into the receptacles 6 and snapped-in behind slightly protruding ends 18 of side surfaces 19 of the receptacles 6.

Figure 2:
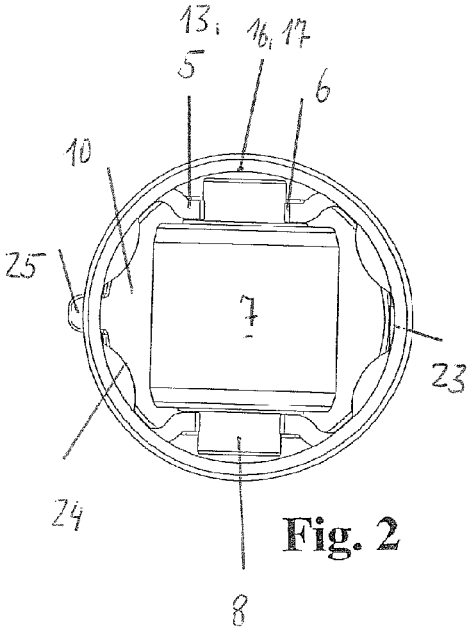
FIG. 2, a top view of a roller tappet.
Figure 3:
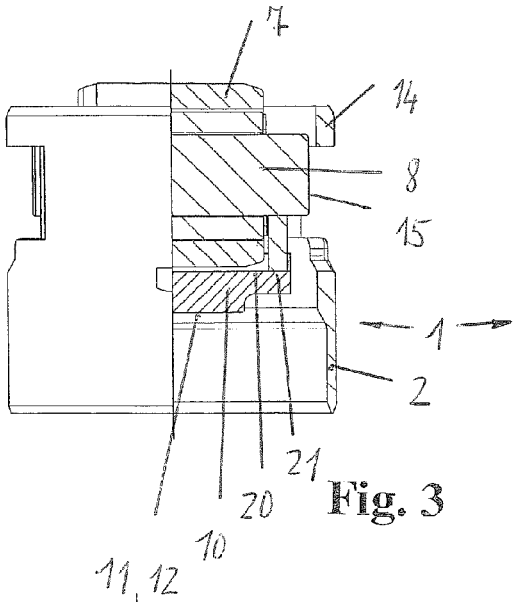
FIG. 3, a semi-sectional side view of the roller tappet.
Figure 4:
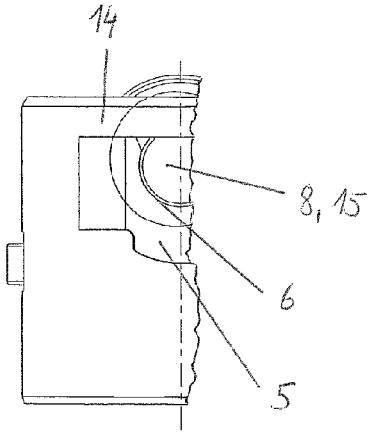
FIG. 4, the roller tappet of FIG. 3 turned through 90°.

As can be seen best from FIGS. 2, 4, the pin 8 is given an axial guidance through a contact of its respective end 15 with an inner side 16 of a bow-shaped segment 17 of the circumferential ring 13 associated to the corresponding flat 5.

LIST OF REFERENCE NUMERALS

1 Roller tappet
2 Housing
3 End
4 Outer peripheral surface
5 Flat
6 Receptacle
7 Cam roller
8 Pin
9 Inner peripheral surface
10 Bridge member
11 Driven side end
12 Support
13 Upper side of flat
14 Circumferential ring
15 End
16 Inner side
17 Segment
18 End
19 Side surface
20 Drive side end
21 Undersurface
22 Not used
23 Lug
24 Outer peripheral surface
25 Extension
26 Aperture
27 Rolling bearing mounting

The invention claimed is:

1. A roller tappet, comprising a housing having a drive side end on which are arranged two diametrically opposing flats that are pressed in from an outer peripheral surface of the housing, each of said flats comprising a receptacle, a pin carrying a cam roller being mounted in said flats, an inner peripheral surface of the housing, as viewed in a drive distal direction, being penetrated axially below the cam roller by a bridge member, and a driven side end of the bridge member comprising a support for a tappet follower, the outer peripheral surface of the housing, except for the flats, is configured without steps as a closed circumferential ring that, as viewed in a drive direction, extends directly above upper sides of the flats, said upper sides extend with a bowstring-like shape through the housing, said circumferential ring being adjoined by the drive side end, and the receptacles in the flats being configured in form of semi-shell-shaped recesses that start from said upper sides and are in osculating contact with the pin.

2. A roller tappet according to claim 1, wherein the pin is given an axial guidance through a contact of a respective one of its ends with an inner side of a bow-like segment of the circumferential ring associated to a corresponding one of the flats.

3. A roller tappet according to claim 1, wherein in a pre-assembled state the receptacles are configured such that a distance between protruding ends of opposing side surfaces of the receptacles at the upper sides is not smaller than a diameter of the pin.

4. A roller tappet according to claim 1, wherein the receptacles are configured such that ends of opposing side surfaces of the receptacles are bent to taper towards each other at a level of the upper sides and engage partially over the pin to realize a snap fixing of the pin in drive direction.

5. A roller tappet according to claim 1, wherein the housing together with the flats which are integrally connected to the housing is made out of thin-walled sheet steel.

6. A roller tappet according to claim 1, wherein the outer peripheral surface of the housing is fine finished by centerless grinding.

7. A roller tappet according to claim 1, wherein the pin is core hardened.

8. A roller tappet according to claim 1, wherein the bridge member is a separate thin-walled element and bears in the drive direction through a drive side end against undersurfaces of the flats and is retained in driven direction through the driven side end on at least one lug that projects inwards from the inner peripheral surface of the housing.

9. A roller tappet according to claim 8, wherein a one-piece or multi-piece finger-like extension projects from an outer peripheral surface of the bridge member and extends through an aperture of the housing to protrude beyond the outer peripheral surface of the housing and thus forms an anti-rotation device.

10. A roller tappet according to claim 8, wherein the bridge member is a punched and bent sheet metal component.

11. A roller tappet according to claim 1, wherein the cam roller extends on the pin via a rolling bearing mounting.

* * * * *